US011053780B2

(12) United States Patent
Chen et al.

(10) Patent No.: US 11,053,780 B2
(45) Date of Patent: Jul. 6, 2021

(54) PRESSURIZED TEST DEVICE AND METHOD FOR IN-SITU MINING NATURAL GAS HYDRATES BY JETS

(71) Applicant: Jilin University, Jilin (CN)

(72) Inventors: Chen Chen, Jilin (CN); Ying Zhang, Jilin (CN); Dongbin Pan, Jilin (CN); Jiang Zhu, Jilin (CN); Lianghao Zhai, Jilin (CN); Xitong Li, Jilin (CN); Han Zhang, Jilin (CN); Ying Zhu, Jilin (CN); Chengcai Jin, Jilin (CN)

(73) Assignee: Jilin University, Changchun (CN)

( * ) Notice: Subject to any disclaimer, the term of this patent is extended or adjusted under 35 U.S.C. 154(b) by 0 days.

(21) Appl. No.: 16/744,460

(22) Filed: Jan. 16, 2020

(65) Prior Publication Data

US 2020/0232305 A1 Jul. 23, 2020

(30) Foreign Application Priority Data

Jan. 21, 2019 (CN) ..... 201910052889.0

(51) Int. Cl.

| | |
|---|---|
| ***E21B 43/01*** | (2006.01) |
| ***E21B 47/07*** | (2012.01) |
| ***E21B 7/18*** | (2006.01) |
| ***E21B 43/18*** | (2006.01) |
| ***E21B 43/36*** | (2006.01) |
| *E21B 41/00* | (2006.01) |

(52) U.S. Cl.

CPC ..... *E21B 43/01* (2013.01); *E21B 7/18* (2013.01); *E21B 43/18* (2013.01); *E21B 43/36* (2013.01); *E21B 47/07* (2020.05); *E21B 41/0099* (2020.05)

(58) Field of Classification Search

CPC ..... E21B 43/01; E21B 43/18; E21B 43/36; E21B 43/168; E21B 47/07; E21B 7/18; E21B 41/0099

See application file for complete search history.

(56) References Cited

U.S. PATENT DOCUMENTS

2016/0357888 A1* 12/2016 Li ..... E21B 43/34
2018/0045029 A1 2/2018 Goksel

FOREIGN PATENT DOCUMENTS

| | | | |
|---|---|---|---|
| CN | 106761588 | A | 5/2017 |
| CN | 107642346 | A | 1/2018 |
| CN | 108375660 | A | 8/2018 |
| CN | 208109793 | U | 11/2018 |

* cited by examiner

*Primary Examiner* — Taras P Bemko
*Assistant Examiner* — Yanick A Akaragwe

(57) ABSTRACT

The present invention discloses a pressurized test device and method for in-situ mining natural gas hydrates by jets, relating to the field of exploitation of marine natural gas hydrates. The device comprises an injection system, a jet breakup system, an annular pressure system, an axial pressure system, a backpressure system, a vacuum system, a simulation system, a collecting and processing system and a metering system, all of which can operate independently by controlling pipe valves on pipelines. The loading of the confining pressure of the device is independent of the loading of the axial pressure, without interference to each other. Meanwhile, the jet breakup process of natural gas hydrate-containing sediments can be observed in real time by a video camera.

5 Claims, 5 Drawing Sheets

PRESSURIZED TEST DEVICE AND METHOD FOR IN-SITU MINING NATURAL GAS HYDRATES BY JETS

CROSS-REFERENCE TO RELATED APPLICATIONS

This application claims the benefit of priority from Chinese Patent Application No. CN 201910052889.0, filed on Jan. 21, 2019. The content of the aforementioned application, including any intervening amendments thereto, is incorporated herein by reference in its entirety.

TECHNICAL FIELD

The present invention relates to the field of exploitation of marine natural gas hydrates and in particular to a pressurized test device and method for in-situ mining natural gas hydrates by jets.

BACKGROUND OF THE PRESENT INVENTION

Natural gas hydrates (NGH), as a white solid crystalline substance formed by the interaction of small-molecular gases such as light hydrocarbons, carbon dioxide and hydrogen sulfide with water under certain conditions, have advantages of high energy density, formation under certain conditions, great reserves, and vast area in distribution. The total amount of organic carbon in natural gas hydrates worldwide is twice the explored conventional fossil organic carbon reserves. Due to the huge potential of natural gas hydrates, there has been a surge of research on prospection, trial production, and exploration of natural gas hydrates worldwide in recent decades. A long-term research plan for natural gas hydrates has been made in the United States, Japan, Canada, India, and South Korea and other countries. How to safely, efficiently and environmentally mine natural gas hydrate resources has become the advanced subject and focus of countries around the world.

At present, conventional natural gas mining methods include thermal excitation mining, pressure relief mining, chemical reagent injection mining and $CO_2$ displacement mining. Compared with conventional oil and gas reservoirs, marine natural gas hydrate reservoirs have characteristics of shallow buried depth, non-diagenesis and low permeability. Therefore, if the marine natural gas hydrates are mined simply by the four mining methods, there are great limitations: the pressure relief mining may cause the secondary formation of natural gas hydrates or the formation of ice, thereby blocking the permeation path and being disadvantageous for long-term mining; the thermal excitation mining has low heat utilization and heating only in a small range can be performed; the chemical reagent injection mining has disadvantages of expensive chemical reagents, slow effect to the natural gas hydrate reservoirs, and environmental pollution; and the $CO_2$ displacement mining has a long mining cycle and requires the natural gas hydrate reservoirs to be highly permeable.

Breakup by erosion using water jets is a new method for mining marine natural gas hydrates. For mining by water jets, since the natural gas hydrate reservoirs have a mechanical strength lower than deep-sea oil and gas reservoirs and have a shallow occurrence depth, breakup can be realized without huge energy input to obtain natural gas hydrate particles. In addition, the mining by water jets does not need to decompose natural gas hydrates in the reservoirs through pressure or temperature transfer, without any requirement on the heat transfer and pressure transfer channels, thus only low requirement on permeability. Meanwhile, the mining by water jets is not affected by the change in temperature and pressure conditions, which is caused by the decomposition of natural gas hydrates to generate secondary natural gas hydrates that hinder the reaction. This mining method is more broadly applicable than other methods, and is considered to be promising. Therefore, it is of great significance to study the principles and rules of the breakup of natural gas hydrates by jets.

The marine natural gas hydrate-containing sediments exist in a high-pressure environment. When experiments for breakup of natural gas hydrates by water jets are conducted, in order to simulate the in-situ marine environment, it is of great importance to ensure the confining pressure and axial pressure loading to the natural gas hydrate-containing sediments. Failure to meet the actual high-pressure occurrence conditions for natural gas hydrate-containing sediments during the breakup experiments by jets will lead to inaccurate principles and rules of the breakup of natural gas hydrate-containing sediments by jets.

SUMMARY OF THE PRESENT INVENTION

An objective of the present invention is to provide a pressurized test device for in-situ mining natural gas hydrates by jets. A pipe valve is arranged in each of systems included in the device and the systems can operate independently, leading to high safety.

Another objective of the present invention is to provide a pressurized test method for in-situ mining natural gas hydrates by jets.

The pressurized test device for in-situ mining natural gas hydrates by jets in the present invention comprises an injection system, a jet breakup system, an annular pressure system, an axial pressure system, a backpressure system, a vacuum system, a simulation system, a collecting and processing system and a metering system;

the injection system, the axial pressure system and the vacuum system are connected to a gas inlet of a three-way valve by a gas intake pipe and two gas outlets of the three-way valve are communicated with the simulation system respectively by a gas injection pipe and an axial pressure pipe, and a pressure sensor I and a pipe valve I are arranged on the gas injection pipe; the injection system is configured to inject, into the simulation system, methane gas that is used for synthesis of natural gas hydrates, and pressurize the methane gas to a pressure desired by synthesis of natural gas hydrates; the injection system comprises a methane gas cylinder, a pressure relief valve, a pipe valve II, a pressure regulating valve I, a booster pump, an air compressor, a cushion container, a gas flow control meter, a check valve and a pipe valve III; the methane gas cylinder is connected to the gas intake pipe by a first pipeline on which the pressure relief valve, the pipe valve II, the pressure regulating valve I, the gas flow control meter, the check valve and the pipe valve III are successively arranged; a gas intake end of the booster pump is connected to the air compressor by a second pipeline on which a pressure regulating valve II is arranged; a gas discharge end of the booster pump is connected to the first pipeline respectively by a third pipeline and a fourth pipeline; a joint of the third pipeline and the first pipeline is located between the pressure relief valve and the pipe valve II, and a pipe valve IV is arranged on the third pipeline; a joint of the fourth pipeline and the first pipeline is located between the pipe valve II and the pressure regulating valve I, and a pipe valve V and a pipe valve VI are arranged on the fourth pipeline; a pressure gauge is arranged on the cushion container; the cushion container is connected to the fourth pipeline by a fifth pipeline; and a joint of the fifth pipeline and the fourth pipeline is located between the pipe valve V and the pipe valve VI;

the jet breakup system is communicated with the simulation system by a jet pipe; the jet breakup system is configured to jet, to the simulation system, a high-pressure water flow that breaks natural gas hydrate-containing sediments already formed in the simulation system; the jet breakup system comprises a jet pump, a jet pipe, a jet nozzle and a lifting mechanism; the jet pump is connected to the jet pipe, and a pipe valve VII is arranged between the jet pump and the jet pipe; the jet pipe penetrates through the top of a visual test cabin of the simulation system and extends into the visual test cabin; the jet pipe is fixed on the lifting mechanism; and the jet nozzle is mounted at a jetting end of the jet pipe;

the annular pressure system is communicated with an annular pressure hole on the visual test cabin; the annular pressure system is configured to provide, to the simulation system, a confining pressure of in-situ submarine natural gas hydrate-containing sediments; the annular pressure system comprises an annular pressure pump and an annular pressure rubber sleeve; the annular pressure pump is communicated with the annular pressure rubber sleeve by a pipeline on which a pressure sensor II and a pipe valve VIII are arranged; the annular pressure rubber sleeve is arranged in the visual test cabin; a sealing strip and a sealing ring are arranged in a gap between the annular pressure rubber sleeve and a front end cover and a visual window;

the axial pressure system is communicated with the simulation system; the axial pressure system is configured to provide, to the simulation system, an axial pressure of in-situ submarine natural gas hydrate-containing sediments; the axial pressure system comprises a constant-flux pump, an axial pressure passage, an axial pressure loading chamber, a loading shaft and a pressure plate; the constant-flux pump is connected to the gas intake pipe by a sixth pipeline on which a pipe valve IX is arranged; the axial pressure passage is communicated with the axial pressure loading chamber arranged in a rear end cover; one end of the loading shaft is arranged in the axial pressure loading chamber, and the other end of the loading shaft runs through the rear end cover and into a visual test cabin body to be connected to the pressure plate; and a sealing strip and a sealing ring are arranged in a gap between the pressure plate and the annular pressure rubber sleeve, a gap between the loading shaft and the annular pressure rubber sleeve, a gap between the loading shaft and the rear end cover, and a gap between the axial pressure loading chamber and the rear end cover;

the backpressure system comprises a gas guide pipe, a backpressure valve, a backpressure pump and a backpressure cushion container; one end of the gas guide pipe is communicated with the jet pipe, and the other end of the gas guide pipe is communicated with the backpressure cushion container; the backpressure valve, a pipe valve X and a pressure sensor III are arranged on the gas guide pipe; the backpressure cushion container is communicated with the backpressure pump; and a pipe valve XI is arranged between the backpressure cushion container and the backpressure pump;

the vacuum system comprises a vacuum meter, a vacuum container and a vacuum pump; one end of the vacuum container is connected to the vacuum pump, and the other end of the vacuum container is connected to the gas intake pipe by a seventh pipeline on which a pipe valve XII, a safety valve and a pressure sensor IV are successively arranged; and the vacuum meter is arranged on the vacuum container;

the collecting and processing system comprises a pressure sensor I, a pressure sensor II, a pressure sensor III, a pressure sensor IV, a temperature sensor and a control terminal; and the pressure sensor I, the pressure sensor II, the pressure sensor III, the pressure sensor IV and the temperature sensor are all communicatively connected to the control terminal;

the metering system comprises a dryer, a three-phase separator and a micro-gas metering device; the three-phase separator is communicated with the gas guide pipe; a gas discharge end on the top of the three-phase separator is communicated with the micro-gas metering device; and the dryer is arranged between the three-phase separator and the micro-gas metering device; and the simulation system comprises a thermostat, the visual test cabin, an overturning support and a video camera; the overturning support is arranged on the inner top of the thermostat; the visual test cabin is arranged on the overturning support and comprises the visual test cabin body, the front end cover and the rear end cover, the front end cover is fastened to a front end of the visual test cabin body by a sealing valve, and the visual window is arranged on the front end cover; the rear end cover is fastened to a rear end of the visual test cabin body by the sealing valve; the video camera is arranged outside the visual test cabin and faces the visual window.

The jet breakup system is 20 mm away from the visual window.

The loading shaft has a piston stroke of 30 mm.

There are three temperature sensors, all of which are arranged on a sidewall of the visual test cabin.

The present invention further provides a pressurized test method for in-situ mining natural gas hydrates by jets, using the test device described above, comprising following steps:

step 1: before testing, cleaning and naturally drying a visual test cabin, and preparing, cleaning with deionized water and oven drying quartz sandstone or silty mudstone;

step 2: uniformly mixing the quartz sandstone or silty mudstone prepared in the step 1 with brine, putting the mixture wrapped by an annular pressure rubber sleeve in a visual test cabin, putting the visual test cabin in a thermostat in a sealed state, and injecting water into an axial pressure loading chamber by a constant-flux pump until an axial pressure of in-situ submarine natural gas hydrate-containing sediments to be simulated is reached; injecting water into an annular pressure hole on the visual test cabin by an annular pressure pump until a confining pressure of in-situ submarine natural gas hydrate-containing sediments to be simulated is reached; adjusting the position and jetting distance of a jet nozzle, adjusting a jet pump, and setting a jetting velocity desired by a test;

step 3: feeding air into the thermostat to cool the whole visual test cabin in air bath, and feeding methane gas into the visual test cabin by an injection system, the amount of methane gas being determined by the saturation of the natural gas hydrate-containing sediments; setting the temperature of the air bath to be a temperature desired by natural gas hydrates; and obtaining natural gas hydrate sediment samples at the end of synthesis of natural gas hydrates;

step 4: jet breakup: at the end of synthesis of natural gas hydrates, decreasing the temperature of the air bath to below 242K-271K, discharging the residual methane gas and feeding brine to flood the natural gas hydrate sediment samples;

adjusting the pump capacity and pumping time of the annular pressure pump and the constant-flux pump to reach real axial pressure and confining pressure conditions of in-situ submarine natural gas hydrate-containing sediments, and setting the temperature of the air bath to be a reaction temperature set for the test; activating the jet breakup system for a jet breakup test, capturing the jet breakup process by a video camera, and recording the temperature according to the temperature sensor;

step 5: gas metering: as the jetting progresses, discharging the mixture from the gas guide pipe of the visual test cabin into a three-phase separator where gas is separated, and drying the gas by a drying pipe; increasing the temperature of the air bath, decomposing remaining natural gas hydrates in the visual test cabin, and metering the total amount of the decomposed methane gas at the end of decomposition; and step 6: at the end of the test, taking the visual test cabin out, observing and recording the breakup effect of the natural gas hydrate-containing sediments, and analyzing data.

By the design solution, the present invention can have following beneficial effects. With the use of the pressurized test device and method for in-situ mining natural gas hydrates by jets in the present invention, systems included in the device can operate independently. For safety, a pipe valve is arranged in each of the systems. The axial pressure loading direction is identical to the arrangement direction of the visual window, and the axial pressure loading is performed by dual-seal to avoid leakage. The confining pressure loading direction is perpendicular to the arrangement direction of the visual window, and the confining pressure loading direction is independent of the axial pressure loading, without interference to each other. Meanwhile, the jet breakup process of natural gas hydrate-containing sediments can be observed in real time by a video camera. The real confining pressure and axial pressure conditions and the flooded environment of the marine in-situ natural gas hydrate-containing sediments can be simulated and real and reliable data can be provided, thereby providing theoretical support for the mining of marine natural gas hydrates.

BRIEF DESCRIPTION OF THE DRAWINGS

The accompanying drawings illustrated herein, which constitute part of the present application, are configured to provide further understanding of the present invention, and exemplary embodiments of the present invention and the description thereof are configured to explain the present invention and not intended to inappropriately limit the present invention. In the drawings.

REFERENCE NUMERALS

1: methane gas cylinder; 2: relief valve; 301: pressure regulating valve I; 302: pressure regulating valve II; 401: pipe valve I; 402: pipe valve II; 403: pipe valve III; 404: pipe valve IV; 405: pipe valve V; 406: pipe valve VI; 407: pipe valve VII; 408: pipe valve VIII; 409: pipe valve IX; 410: pipe valve X; 411: pipe valve XI; 412: pipe valve XII; 5: booster pump; 6: control terminal; 7: air compressor; 8: vacuum pump; 9: cushion container; 10: backpressure cushion container; 11: gas flow control meter; 12: check valve; 13: constant-flux pump; 14: vacuum meter; 15: pressure gauge; 16: vacuum container; 17: three-way valve; 1801: pressure sensor I; 1802: pressure sensor II; 1803: pressure sensor III; 1804: pressure sensor IV; 19: safety valve; 20: jet pump; 21: backpressure valve; 22: backpressure pump; 23: dryer; 24: three-phase separator; 25: thermostat; 26: micro-gas metering device; 27: annular pressure pump; 28: visual test cabin; 29: temperature sensor; 30: lifting mechanism; 31: jet pipe; 32: jet nozzle; 33: annular pressure rubber sleeve; 34: gas injection pipe; 35: axial pressure loading chamber; 36: rear end cover; 370: axial pressure pipe; 37: axial pressure passage; 38: annular pressure hole; 39: loading shaft; 40: sealing strip; 41: sealing ring; 42: pressure plate; 43: visual window; 44: sealing valve; 45: overturning support; 46: front end cover; and 47: video camera.

DETAILED DESCRIPTION OF THE PRESENT INVENTION

To explain the present invention more clearly, the present invention will be further described below with reference to the accompanying drawings by preferred embodiments. It should be understood by those skilled in the art that the content to be specifically described below is illustrative rather than limiting, and is not intended to limit the protection scope of the present invention.

Figure 1:
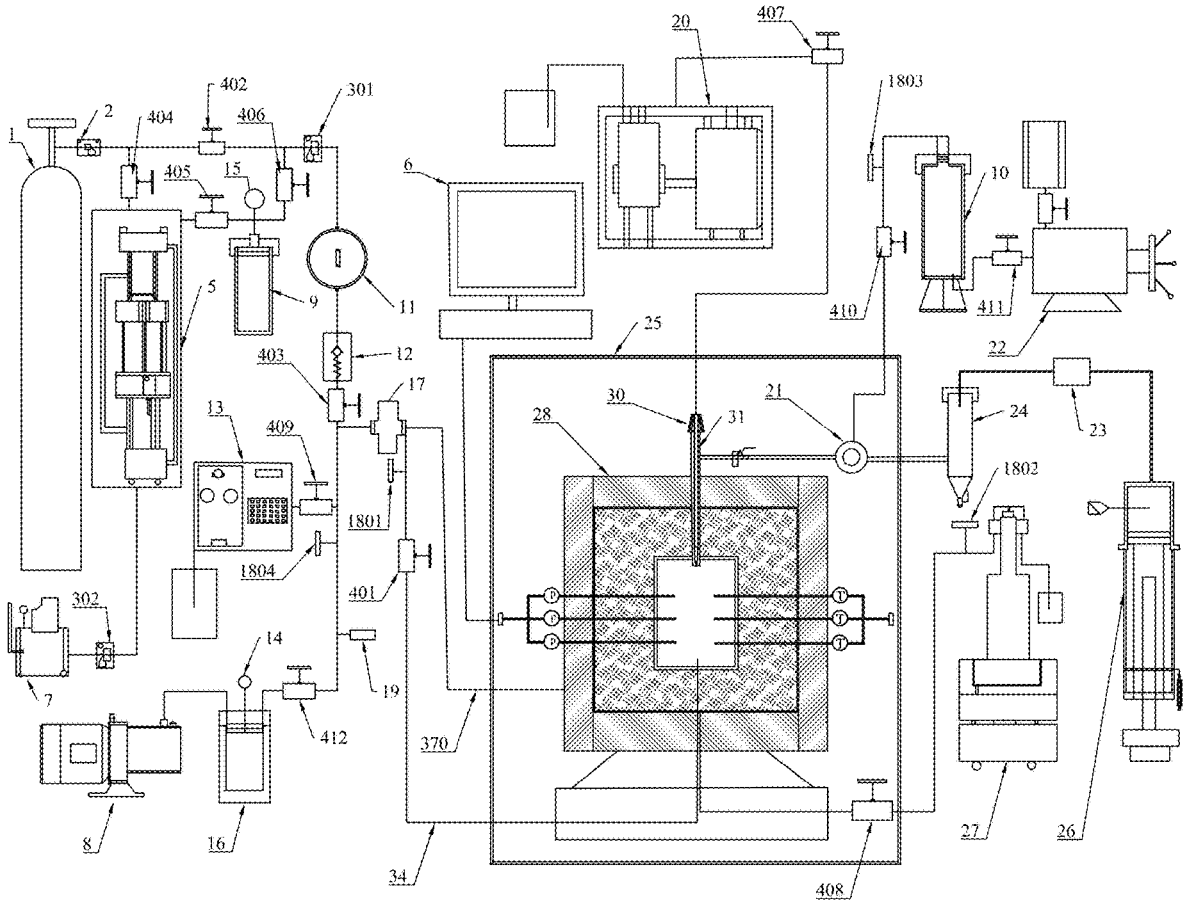
FIG. 1 is a structure diagram of a pressurized test device for in-situ mining natural gas hydrates by jets according to the present invention.
Figure 2:
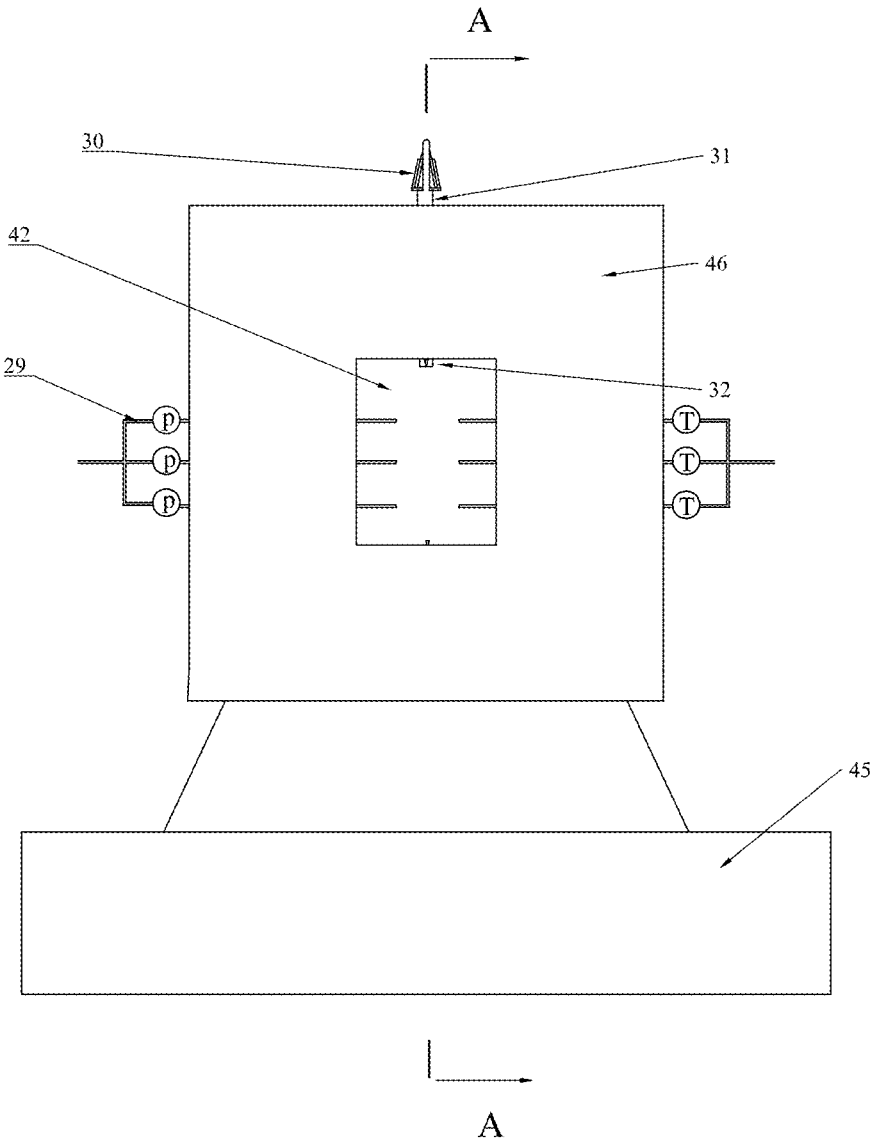
FIG. 2 is a front view of a visual test cabin according to the present invention.
Figure 3:
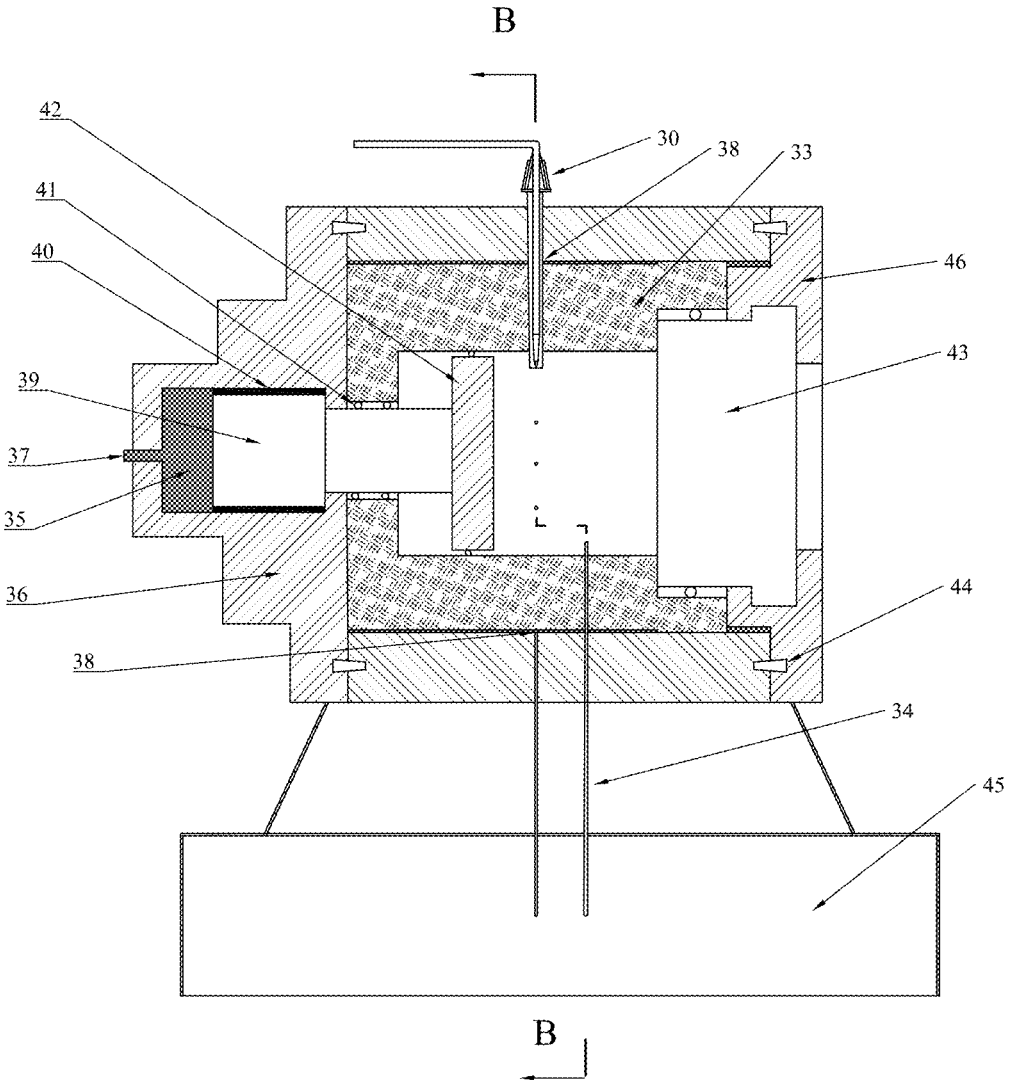
FIG. 3 is a sectional view of the visual test cabin taken along A-A of FIG. 2 according to the present invention.
Figure 4:
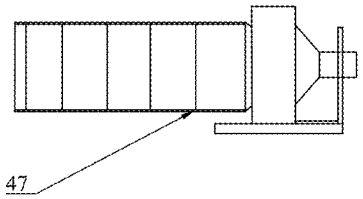
FIG. 4 is a schematic view of a video camera according to the present invention.
Figure 5:
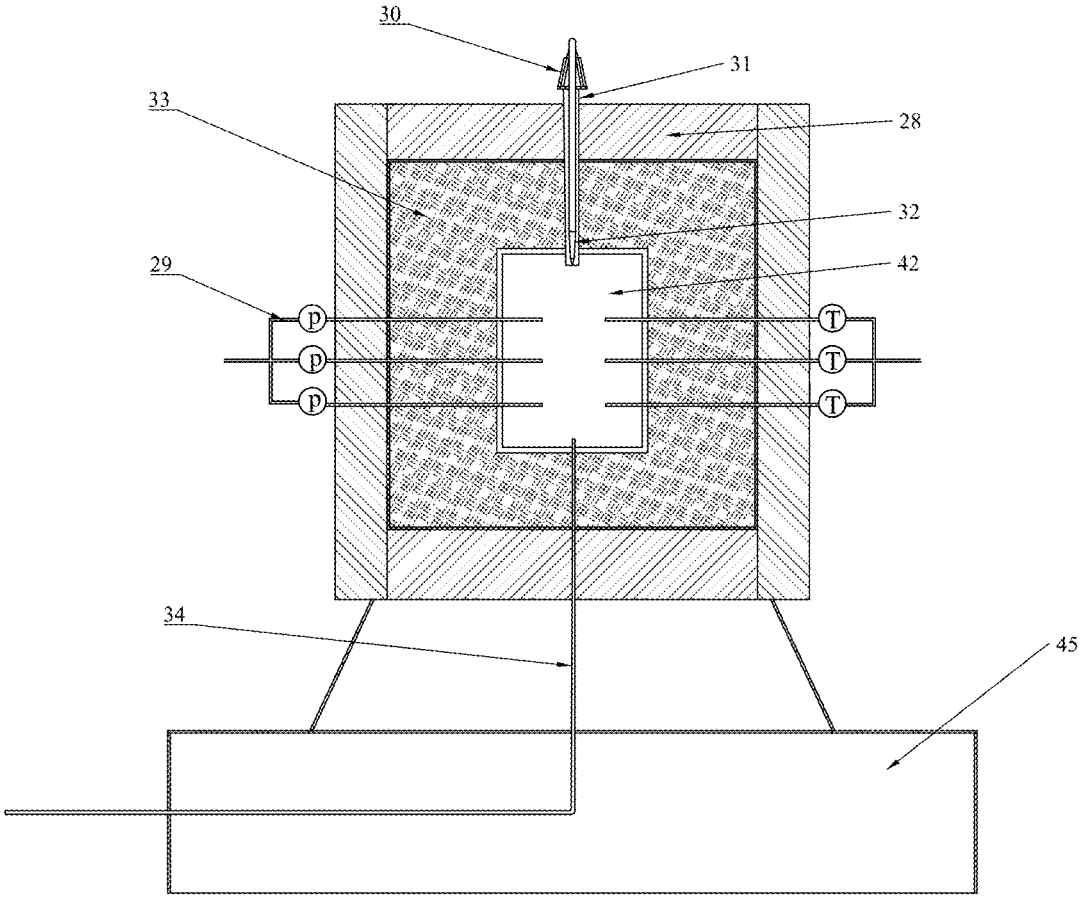
FIG. 5 is a sectional view of the visual test cabin taken along B-B of FIG. 3 according to the present invention.
Figure 6:
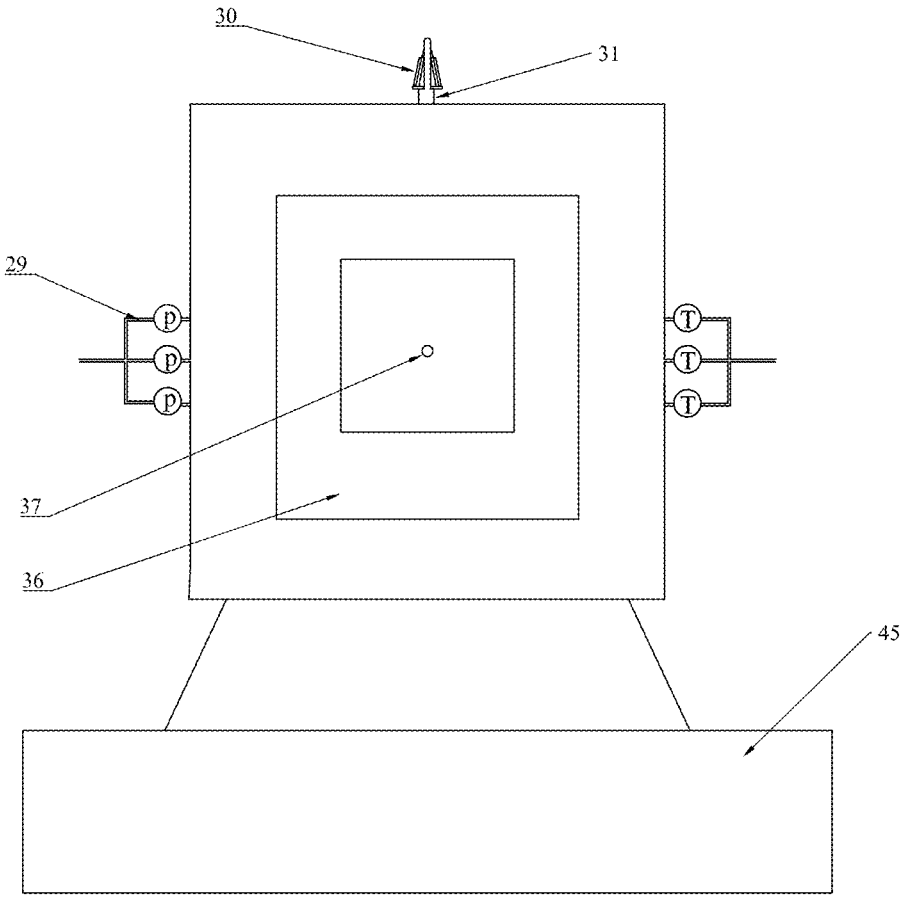
FIG. 6 is a rear view of the visual test cabin according to the present application.

As shown in FIGS. 1 to 6, the pressurized test device for in-situ mining natural gas hydrates by jets in this embodiment comprises an injection system, a jet breakup system, an annular pressure system, an axial pressure system, a backpressure system, a vacuum system, a simulation system, a collecting and processing system and a metering system.

The injection system, the axial pressure system and the vacuum system are connected to a gas inlet of a three-way valve 17 by a gas intake pipe and two gas outlets of the three-way valve 17 are communicated with the simulation system respectively by a gas injection pipe 34 and an axial pressure pipe 370, and a pressure sensor I 1801 and a pipe valve I 401 are arranged on the gas injection pipe 34. The injection system is configured to inject, into the simulation system, methane gas that is used for synthesis of natural gas hydrates, and pressurize the methane gas to a pressure desired by synthesis of natural gas hydrates. The injection system comprises a methane gas cylinder 1, a pressure relief valve 2, a pipe valve II 402, a pressure regulating valve I 301, a booster pump 5, an air compressor 7, a cushion container 9, a gas flow meter 11, a check valve 12 and a pipe valve III 403. The methane gas cylinder 1 is connected to the gas intake pipe by a first pipeline on which the pressure relief valve 2, the pipe valve II 402, the pressure regulating valve I 301, the gas flow meter 11, the check valve 12 and the pipe valve III 403 are successively arranged. A gas intake end of the booster pump 5 is connected to the air compressor 7 by a second pipeline on which a pressure regulating valve II 302 is arranged. A gas discharge end of the booster pump 5 is connected to the first pipeline respectively by a third pipeline and a fourth pipeline. A joint of the third pipeline and the first pipeline is located between the pressure relief valve 2 and the pipe valve II 404, and a pipe valve IV 402 is arranged on the third pipeline. A joint of the fourth pipeline and the first pipeline is located between the pipe valve II 402 and the pressure regulating valve I 301, and a pipe valve V 406 and a pipe valve VI 405 are arranged on the fourth pipeline. A pressure gauge 15 is arranged on the cushion container 9; the cushion container 9 is connected to the fourth pipeline by a fifth pipeline. A joint of the fifth pipeline and the fourth pipeline is located between the pipe valve V 405 and the pipe valve VI 406. The methane gas in the methane gas cylinder 1 has a purity of 99.99% and is used for synthesis of natural gas hydrates. The pressure regulating valve I 301 is used for regulating the pressure for injection of the methane gas, and the maximum pressure at the inlet is 20 MPa. The check valve 12 withstands 16 MPa and is configured to prevent the back flow of the methane gas. The methane gas is supplied from the methane gas cylinder 2. The output pressure of the methane gas is determined by the relief valve 2. At insufficient output pressure, the pressure is regulated by the pressure regulating valve I 301, the booster pump 5 and the cushion container 9. When the pressure is well regulated, the methane gas is injected into the simulation system successively by the three-way valve 17 and the gas injection pipe 34.

The jet breakup system is communicated with the simulation system by a jet pipe 31, and the jet breakup system is 20 mm away from the visual window 43 in order to observe the jet breakup process conveniently. The jet breakup system is configured to jet, to the simulation system, a high-pressure water flow that breaks natural gas hydrate-containing sediments already formed in the simulation system. The jet breakup system comprises a jet pump 20, a jet pipe 31, a jet nozzle 32 and a lifting mechanism 30. The jet pump 20 is connected to the jet pipe 31, and a pipe valve VII 407 is arranged between the jet pump 20 and the jet pipe 31. The jet pipe 31 penetrates through the top of a visual test cabin 28 of the simulation system and extends into the visual test cabin 28. The jet pipe 31 is fixed on the lifting mechanism 30. The jet nozzle 32 is mounted at a jetting end of the jet pipe 31. The jet pump 20 provides a stable and continuous high-pressure water flow having a maximum pressure of 50 MPa and a velocity of 100 m/s to break the natural gas hydrate-containing sediments. Different jet nozzles 32 are configured to simulate the influence of different diameters and shapes on the breakup effect of the natural gas hydrate-containing sediments. The lifting mechanism 30 is configured to adjust the distance between the jet nozzles 32 and the natural gas hydrate-containing sediments.

The annular pressure system is communicated with an annular pressure hole 38 on the visual test cabin 28. The annular pressure system is configured to provide, to the simulation system, a confining pressure of in-situ submarine natural gas hydrate-containing sediments. The annular pressure system comprises an annular pressure pump 27 and an annular pressure rubber sleeve 33. The annular pressure pump 27 is communicated with the annular pressure rubber sleeve 33 by a pipeline on which a pressure sensor II 1802 and a pipe valve VIII 408 are arranged. The annular pressure rubber sleeve 33 is arranged in the visual test cabin 28. A sealing strip 40 and a sealing ring 41 are arranged in a gap between the annular pressure rubber sleeve 33 and a front end cover 46 and a visual window 43. Dual-seal is formed by the sealing strip 40 and the sealing ring 41 so that the whole annular pressure system is in a sealed state, without any gas leakage. The annular pressure pump 27 has a maximum operating pressure of 30 MPa. An annular pressure is loaded to the natural gas hydrate-containing sediments by the annular pressure pump 27 to simulate the real natural gas hydrate-containing sediments, in order to faithfully reflect the situation of the natural gas hydrate-containing sediments having a confining pressure.

The axial pressure system is communicated with the simulation system. The axial pressure system is configured to provide, to the simulation system, an axial pressure of in-situ submarine natural gas hydrate-containing sediments. The axial pressure system comprises a constant-flux pump 13, an axial pressure passage 37, an axial pressure loading chamber 35, a loading shaft 39 and a pressure plate 42. The constant-flux pump 13 is connected to the gas intake pipe by a sixth pipeline on which a pipe valve IX 409 is arranged. The axial pressure passage 37 is communicated with the axial pressure loading chamber 35 arranged in a rear end cover 36. One end of the loading shaft 39 is arranged in the axial pressure loading chamber 35, and the other end of the loading shaft 39 runs through the rear end cover 36 and into a visual test cabin body to be connected to the pressure plate 42. The loading shaft 39 has a piston stroke of 30 mm. The axial pressure system and the annular pressure system are independent of each other and can give a pressure separately to faithfully simulate the tri-axial pressure state of the marine natural gas hydrate-containing sediments. A sealing strip 40 and a sealing ring 41 are arranged in a gap between the pressure plate 42 and the annular pressure rubber sleeve 33, a gap between the loading shaft 39 and the annular pressure rubber sleeve 33, a gap between the loading shaft 39 and the rear end cover 36, and a gap between the axial pressure loading chamber 35 and the rear end cover 36. Dual-seal is formed by the sealing strip 40 and the sealing ring 41 so that the whole axial pressure system is in a sealed state. The constant-flux pump 13 has a maximum operating pressure of 50 MPa. A pressure is provided by the constant-flux pump 13 to simulate the axial pressure state of the natural gas hydrate-containing sediments.

The backpressure system comprises a gas guide pipe, a backpressure valve 21, a backpressure pump 22 and a backpressure cushion container 10. One end of the gas guide pipe is communicated with the jet pipe 31, and the other end of the gas guide pipe is communicated with the backpressure cushion container 10. The backpressure valve 21, a pipe valve X 410 and a pressure sensor III 1803 are arranged on the gas guide pipe. The backpressure cushion container 10 is communicated with the backpressure pump 22. A pipe valve XI 411 is arranged between the backpressure cushion container 10 and the backpressure pump 22, and the backpressure pump 22 has an operating pressure of 0 MPa to 50 MPa. Due to high pressure, high discharge rate and great pressure fluctuation in the visual test cabin 28, the use of the backpressure pump can ensure steady fluid so that it is convenient to conduct the test.

The vacuum system comprises a vacuum meter 14, a vacuum container 16 and a vacuum pump 8. One end of the vacuum container 16 is connected to the vacuum pump 8, and the other end of the vacuum container 16 is connected to the gas intake pipe by a seventh pipeline on which a pipe valve XII 412, a safety valve 19 and a pressure sensor IV 1804 are successively arranged. The vacuum meter 14 is arranged on the vacuum container 16. The vacuum pump 8 has a degree of vacuum of 0.1 Pa. The vacuum container 16 is configured to store gas pumped from the simulation system. The vacuum meter 14 is configured to indicate the storage amount of gas. At the end of the synthesis of the natural gas hydrate-containing sediments, the visual test cabin 28 is brought into vacuum, in order to ensure the accuracy of the test.

The collecting and processing system comprises a pressure sensor I 1801, a pressure sensor II 1802, a pressure sensor III 1803, a pressure sensor IV 1804, a temperature sensor 29 and a control terminal 6. The pressure sensor I 1801, the pressure sensor II 1802, the pressure sensor III 1803, the pressure sensor IV 1804 and the temperature sensor 29 are all communicatively connected to the control terminal 6. The collected pressure and temperature data is transmitted to the control terminal 6 to be processed. The pressure sensor I 1801, the pressure sensor II 1802, the pressure sensor III 1803 and the pressure sensor IV 1804 can measure a maximum pressure of 25 MPa, at a precision of 0.1%. There are three temperature sensors 29, all of which are arranged on a sidewall of the visual test cabin 28. The temperature sensor 29 is configured to measure the temperature in the visual test cabin 28 during the breakup process of the natural gas hydrate-containing sediments. The temperature sensor 29 can measure the temperature between −20° C. and 100° C.

The metering system comprises a dryer 23, a three-phase separator 24 and a micro-gas metering device 26. The three-phase separator 24 is communicated with the gas guide pipe. A gas discharge end on the top of the three-phase separator 24 is communicated with the micro-gas metering device 26. The dryer 23 is arranged between the three-phase separator 24 and the micro-gas metering device 26.

The mixture from the gas guide pipe is separated by the three-phase separator 24 into gas, liquid and solid. The gas is discharged from the top of the three-phase separator 24, dried by the dryer 23 and then passed to the micro-gas metering device 26. The micro-gas metering device 26 is configured to collect gas produced during the breakup process of the natural gas hydrate-containing sediments by water jets, in order to collect and meter the gas.

The simulation system comprises a thermostat 25, the visual test cabin 28, an overturning support 45 and a video camera 47. The overturning support 45 is arranged on the inner top of the thermostat 25. The visual test cabin 28 is arranged on the overturning support 45 and comprises the visual test cabin body, the front end cover 46 and the rear end cover 36, the front end cover 46 is fastened to a front end of the visual test cabin body by a sealing valve 44, and the visual window 43 is arranged on the front end cover 46. The rear end cover 36 is fastened to a rear end of the visual test cabin body by the sealing valve 44. The thermostat 25 is configured to keep a constant temperature during the synthesis of natural gas hydrates. The visual test cabin 28 can withstand a pressure 0 MPa to 50 MPa, and is 3000 mm×3000 mm×400 mm in size. The synthesized natural gas hydrate sediment samples are 100 mm×100 mm×150 mm in size. The visual window 43 is a visual window made of sapphire, which has high strength, and by which the breakup process of the natural gas hydrate-containing sediments is observed and the moment of breakup is captured by the video camera 47 arranged in opposite to the visual window 43. A sealing strip 40 and a sealing ring 41 are arranged at the joint of the axial pressure loading chamber 35, the front end cover 46 and the rear end cover 36, in order to seal against the outer wall and avoid gas leakage. By adjusting the overturning base 45, it is convenient to place or take out the natural gas hydrate sediment samples.

The pipe valve I 401, the pipe valve II 402, the pipe valve III 403, the pipe valve IV 404, the pipe valve V 405, the pipe valve VI 406, the pipe valve VII 407, the pipe valve VIII 408, the pipe valve IX 409, the pipe valve X 410, the pipe valve XI 411 and the pipe valve XII 412 are configured to determine whether to communicate their pipelines. The safety valve 19 is configured to control the safety of the whole system.

The pressurized test method for in-situ mining natural gas hydrates by jets in the present invention comprises following steps:

step 1: before testing, cleaning and naturally drying a visual test cabin 28, and preparing, cleaning with deionized water and oven drying quartz sandstone or silty mudstone;

step 2: uniformly mixing the quartz sandstone or silty mudstone with brine to obtain a mixture, filling the mixture into the annular pressure rubber sleeve 33 by a deionized test shovel, putting the mixture wrapped by the annular pressure rubber sleeve 33 in a visual test cabin 28, tightening a front end cover 46 of the visual test cabin 28 to the visual test cabin by a sealing valve 44 at the end of filling and putting the visual test cabin 28 in a thermostat 25, and injecting water into an axial pressure loading chamber 35 by a constant-flux pump 13 until an axial pressure of in-situ submarine natural gas hydrate-containing sediments is reached; injecting water into an annular pressure hole 38 on the visual test cabin 28 by an annular pressure pump 27 until a confining pressure of in-situ submarine natural gas hydrate-containing sediments to be simulated is reached; adjusting the position and jetting distance of a jet nozzle 32, selecting the specification and jet diameter of the jet nozzle 32, adjusting a jet pump 20, and setting a jetting velocity desired by a test;

step 3: feeding air into the thermostat 25 to cool the whole visual test cabin 28 in air bath, and turning on a pipe valve I 401, a pipe valve II 402 and a pipe valve III 403 in the injection system to feed methane gas into the visual test cabin 28 at 350 mL/min, the amount of methane gas being determined by the saturation of the natural gas hydrate-containing sediments, the feeding usually lasting about 20 min to 30 min; setting the temperature of the air bath to be a temperature near the freezing point, and recording the resulting data; and after about 10 h, obtaining natural gas hydrate sediment samples at the end of synthesis of natural gas hydrates;

step 4: jet breakup: at the end of synthesis of natural gas hydrates, decreasing the temperature of the air bath to below 242K-271K, discharging the residual methane gas by a vacuum pump 8 immediately when the temperature becomes stable, and quickly feeding the cooled brine to flood the natural gas hydrate sediment samples; adjusting the pump capacity and pumping time of the annular pressure pump 27 and the constant-flux pump 13 to reach real axial pressure and confining pressure conditions of in-situ submarine natural gas hydrate-containing sediments, and setting the temperature of the air bath to be a reaction temperature set for the test; activating the jet breakup system for a jet breakup test, capturing the jet breakup process by a video camera 47, and recording the temperature according to the temperature sensor 29;

step 5: gas metering: as the jetting progresses, discharging the mixture from the gas guide pipe of the visual test cabin 28 into a three-phase separator 24 where gas is separated, and drying the gas by a drying pipe 23; increasing the temperature of the air bath, decomposing remaining natural gas hydrates in the visual test cabin 28, and metering the total amount of the decomposed methane gas at the end of decomposition; and step 6: at the end of the test, shutting off the jet pump 20, the constant-flux pump 13, the annular pressure pump 27 and other instruments; taking the visual test cabin 28 out, and observing and recording the breakup effect of the natural gas hydrate-containing sediments; taking the natural gas hydrate sediment samples out, cleaning the visual test cabin 28, and analyzing data.

What is claimed is:

1. A pressurized test device for in-situ mining natural gas hydrates by jets, comprising an injection system, a jet breakup system, an annular pressure system, an axial pressure system, a backpressure system, a vacuum system, a simulation system, a collecting and processing system and a metering system;

the injection system, the axial pressure system and the vacuum system are connected to a gas inlet of a three-way valve (17) by a gas intake pipe and two gas outlets of the three-way valve (17) are communicated with the simulation system respectively by a gas injection pipe (34) and an axial pressure pipe (370), and a pressure sensor I (1801) and a pipe valve I (401) are arranged on the gas injection pipe (34); the injection system is configured to inject, into the simulation system, methane gas that is used for synthesis of natural gas hydrates, and pressurize the methane gas to a pressure desired by synthesis of natural gas hydrates; the injection system comprises a methane gas cylinder (1), a pressure relief valve (2), a pipe valve II (402), a pressure regulating valve I (301), a booster pump (5), an air compressor (7), a cushion container (9), a gas flow control meter (11), a check valve (12) and a pipe valve III (403); the methane gas cylinder (1) is connected to the gas intake pipe by a first pipeline on which the pressure relief valve (2), the pipe valve II (402), the pressure regulating valve I (301), the gas flow control meter (11), the check valve (12) and the pipe valve III (403) are successively arranged; a gas intake end of the booster pump (5) is connected to the air compressor (7) by a second pipeline on which a pressure regulating valve II (302) is arranged; a gas discharge end of the booster pump (5) is connected to the first pipeline respectively by a third pipeline and a fourth pipeline; a joint of the third pipeline and the first pipeline is located between the pressure relief valve (2) and the pipe valve II (402), and a pipe valve IV (404) is arranged on the third pipeline; a joint of the fourth pipeline and the first pipeline is located between the pipe valve II (402) and the pressure regulating valve I (301), and a pipe valve V (405) and a pipe valve VI (406) are arranged on the fourth pipeline; a pressure gauge (15) is arranged on the cushion container (9); the cushion container (9) is connected to the fourth pipeline by a fifth pipeline; and a joint of the fifth pipeline and the fourth pipeline is located between the pipe valve V (405) and the pipe valve VI (406);

the jet breakup system is communicated with the simulation system by a jet pipe (31); the jet breakup system is configured to jet, to the simulation system, a high-pressure water flow that breaks natural gas hydrate-containing sediments already formed in the simulation system; the jet breakup system comprises a jet pump (20), the jet pipe (31), a jet nozzle (32) and a lifting mechanism (30); the jet pump (20) is connected to the jet pipe (31), and a pipe valve VII (407) is arranged between the jet pump (20) and the jet pipe (31); the jet pipe (31) penetrates through the top of a visual test cabin (28) of the simulation system and extends into the visual test cabin (28); the jet pipe (31) is fixed on the lifting mechanism (30); and the jet nozzle (32) is mounted at a jetting end of the jet pipe (31);

the annular pressure system is communicated with an annular pressure hole (38) on the visual test cabin (28); the annular pressure system is configured to provide, to the simulation system, a confining pressure of in-situ submarine natural gas hydrate-containing sediments; the annular pressure system comprises an annular pressure pump (27) and an annular pressure rubber sleeve (33); the annular pressure pump (27) is communicated with the annular pressure rubber sleeve (33) by a pipeline on which a pressure sensor II (1802) and a pipe valve VIII (408) are arranged; the annular pressure rubber sleeve (33) is arranged in the visual test cabin (28); a sealing strip (40) and a sealing ring (41) are arranged in a gap between the annular pressure rubber sleeve (33) and a front end cover (46) and a visual window (43);

the axial pressure system is communicated with the simulation system; the axial pressure system is configured to provide, to the simulation system, an axial pressure of in-situ submarine natural gas hydrate-containing sediments; the axial pressure system comprises a constant-flux pump (13), an axial pressure passage (37), an axial pressure loading chamber (35), a loading shaft (39) and a pressure plate (42); the constant-flux pump (13) is connected to the gas intake pipe by a sixth pipeline on which a pipe valve IX (409) is arranged; the axial pressure passage (37) is communicated with the axial pressure loading chamber (35) arranged in a rear end cover (36); one end of the loading shaft (39) is arranged in the axial pressure loading chamber (35), and the other end of the loading shaft (39) runs through the rear end cover (36) and into a visual test cabin body to be connected to the pressure plate (42); and the sealing strip (40) and the sealing ring (41) are arranged in a gap between the pressure plate (42) and the annular pressure rubber sleeve (33), a gap between the loading shaft (39) and the annular pressure rubber sleeve (33), a gap between the loading shaft (39) and the rear end cover (36), and a gap between the axial pressure loading chamber (35) and the rear end cover (36);

the backpressure system comprises a gas guide pipe, a backpressure valve (21), a backpressure pump (22) and a backpressure cushion container (10); one end of the gas guide pipe is communicated with the jet pipe (31), and the other end of the gas guide pipe is communicated with the backpressure cushion container (10); the backpressure valve (21), a pipe valve X (410) and a pressure sensor III (1803) are arranged on the gas guide pipe; the backpressure cushion container (10) is communicated with the backpressure pump (22); and a pipe valve XI (411) is arranged between the backpressure cushion container (10) and the backpressure pump (22);

the vacuum system comprises a vacuum meter (14), a vacuum container (16) and a vacuum pump (8); one end of the vacuum container (16) is connected to the vacuum pump (8), and the other end of the vacuum container (16) is connected to the gas intake pipe by a seventh pipeline on which a pipe valve XII (412), a safety valve (19) and a pressure sensor IV (1804) are successively arranged; and the vacuum meter (14) is arranged on the vacuum container (16);

the collecting and processing system comprises a pressure sensor I (1801), a pressure sensor II (1802), a pressure sensor III (1803), a pressure sensor IV (1804), a temperature sensor (29) and a control terminal (6); and the pressure sensor I (1801), the pressure sensor II (1802), the pressure sensor III (1803), the pressure sensor IV (1804) and the temperature sensor (29) are all communicatively connected to the control terminal (6);

the metering system comprises a dryer (23), a three-phase separator (24) and a micro-gas metering device (26); the three-phase separator (24) is communicated with the gas guide pipe; a gas discharge end on the top of the three-phase separator (24) is communicated with the micro-gas metering device (26); and the dryer (23) is arranged between the three-phase separator (24) and the micro-gas metering device (26); and the simulation system comprises a thermostat (25), the visual test cabin (28), an overturning support (45) and a video camera (47); the overturning support (45) is arranged on the inner top of the thermostat (25); the visual test cabin (28) is arranged on the overturning support (45) and comprises the visual test cabin body, the front end cover (46) and the rear end cover (36), the front end cover (46) is fastened to a front end of the visual test cabin body by a sealing valve (44), and the visual window (43) is arranged on the front end cover (46); the rear end cover (36) is fastened to a rear end of the visual test cabin body by the sealing valve (44); the video camera (47) is arranged outside the visual test cabin (28) and faces the visual window (43).

2. The pressurized test device for in-situ mining natural gas hydrates by jets according to claim 1, wherein the jet breakup system is 20 mm away from the visual window (43).

3. The pressurized test device for in-situ mining natural gas hydrates by jets according to claim 1, wherein the loading shaft (39) has a piston stroke of 30 mm.

4. The pressurized test device for in-situ mining natural gas hydrates by jets according to claim 1, wherein there are three temperature sensors (29), all of which are arranged on a sidewall of the visual test cabin (28).

5. A pressurized test method for in-situ mining natural gas hydrates by jets, using the test device according to claim 1, comprising following steps:

step 1: before testing, cleaning and naturally drying a visual test cabin (28), and preparing, cleaning with deionized water and oven drying quartz sandstone or silty mudstone;

step 2: uniformly mixing the quartz sandstone or silty mudstone prepared in the step 1 with brine, putting the mixture wrapped by an annular pressure rubber sleeve (33) in a visual test cabin (28), putting the visual test cabin (28) in a thermostat (25) in a sealed state, and injecting water into an axial pressure loading chamber (35) by a constant-flux pump (13) until an axial pressure of in-situ submarine natural gas hydrate-containing sediments to be simulated is reached; injecting water into an annular pressure hole (38) on the visual test cabin (28) by an annular pressure pump (27) until a confining pressure of in-situ submarine natural gas hydrate-containing sediments to be simulated is reached; adjusting the position and jetting distance of a jet nozzle (32), adjusting a jet pump (20), and setting a jetting velocity desired by a test;

step 3: feeding air into the thermostat (25) to cool the whole visual test cabin (28) in air bath, and feeding methane gas into the visual test cabin (28) by an injection system, the amount of methane gas being determined by the saturation of the natural gas hydrate-containing sediments; setting the temperature of the air bath to be a temperature desired by natural gas hydrates; and obtaining natural gas hydrate sediment samples at the end of synthesis of natural gas hydrates;

step 4: jet breakup: at the end of synthesis of natural gas hydrates, decreasing the temperature of the air bath to below 242K-271K, discharging the residual methane gas and feeding brine to flood the natural gas hydrate sediment samples; adjusting the pump capacity and pumping time of the annular pressure pump (27) and the constant-flux pump (13) to reach real axial pressure and confining pressure conditions of in-situ submarine natural gas hydrate-containing sediments, and setting the temperature of the air bath to be a reaction temperature set for the test; activating the jet breakup system for a jet breakup test, capturing the jet breakup process by a video camera (47), and recording the temperature according to the temperature sensor (29);

step 5: gas metering: as the jetting progresses, discharging the mixture from the gas guide pipe of the visual test cabin (28) into a three-phase separator (24) where gas is separated, and drying the gas by a drying pipe (23); increasing the temperature of the air bath, decomposing remaining natural gas hydrates in the visual test cabin (28), and metering the total amount of the decomposed methane gas at the end of decomposition; and step 6: at the end of the test, taking the visual test cabin (28) out, observing and recording the breakup effect of the natural gas hydrate-containing sediments, and analyzing data.

* * * * *